United States Patent [19]

Ohta et al.

[11] Patent Number: 4,713,154

[45] Date of Patent: Dec. 15, 1987

[54] CONTINUOUS ANNEALING AND PICKLING METHOD AND APPARATUS FOR STEEL STRIPS

[75] Inventors: Norio Ohta; Fumiya Yanagishima; Toshikazu Kaihara; Akira Kishida; Kuniaki Sato; Masanobu Ochiai, all of Chiba, Japan

[73] Assignee: Kawasaki Steel Corporation, Kobe, Japan

[21] Appl. No.: 893,476

[22] Filed: Aug. 5, 1986

[30] Foreign Application Priority Data

Aug. 8, 1985 [JP] Japan ..... 60-173134
Jun. 27, 1986 [JP] Japan ..... 61-149782

[51] Int. Cl.[4] ..... C25F 1/06; C25F 7/00
[52] U.S. Cl. ..... 204/145 R; 204/210
[58] Field of Search ..... 204/145 R, 210

[56] References Cited

U.S. PATENT DOCUMENTS

| | | | |
|---|---|---|---|
| 1,704,015 | 3/1929 | Naugle et al. | 148/4 |
| 2,045,392 | 6/1936 | Keintz, Jr. | 148/14 |
| 3,429,792 | 2/1969 | Fukui | 204/145 R |
| 3,826,693 | 7/1974 | Fisher | 148/12.1 |
| 4,618,379 | 10/1986 | Bruno | 204/145 R |

FOREIGN PATENT DOCUMENTS

| | | | |
|---|---|---|---|
| 0106166 | 4/1984 | European Pat. Off. | 204/145 |
| 2760 | 1/1986 | Japan | 204/145 |
| 2082206 | 3/1982 | United Kingdom | 204/145 |

OTHER PUBLICATIONS

Metallurgia, vol. 76, No. 458, Dec. 1967.

*Primary Examiner*—T. M. Tufariello
*Attorney, Agent, or Firm*—Balogh, Osann, Kramer, Dvorak, Genova & Traub

[57] ABSTRACT

In a method of continuously annealing and pickling steel strips successively transferred through a continuous annealing apparatus including heating and cooling zones and a pickling apparatus, annealing the steel strips is effected in reducing atmosphere and thereafter pickling is effected at least by nitric acid electrolytic treatment. In an apparatus for continuously annealing and pickling steel strips, including a continuous annealing furnace and a pickling apparatus, the continuous annealing furnace consists of vertical furnaces capable of advancing a steel strip in a manner substantially repeating upward and downward movements alternately in substantially vertical directions and the pickling apparatus comprises at least a nitric acid electrolytic cell. In another aspect, continuous annealing furnace consists of one pass furnace capable of advancing the steel strip only once and forming a high temperature heating zone and a high temperature cooling zone of the annealing furnace, and vertical furnaces respectively forming a lower temperature heating zone and a low temperature cooling zone and capable of advancing a steel strip in a manner substantially repeating upward and downward movements alternately in substantially vertical directions. The one pass furnace is horizontal or vertical.

8 Claims, 8 Drawing Figures

CONTINUOUS ANNEALING AND PICKLING METHOD AND APPARATUS FOR STEEL STRIPS

BACKGROUND OF THE INVENTION

This invention relates to a method and an apparatus for continuously annealing and pickling steel strips, particularly stainless steel strips, and more particularly to a method and an apparatus for continuously annealing and pickling stainless steel strips to realize advantageous improvement of annealing and pickling treatment faculty and effective shortening of treatment line.

Cold rolled stainless steel strips are generally subjected to the continuous annealing and pickling treatment in an annealing and pickling line which is referred to herein as "APL".

FIG. 1 schematically illustrates an APL as one example of prior art. It comprises a pay-off reel 11, a shearing machine 12 on an entry side, a welder 13, a looper 14 on the entry side, an annealing furnace 15 consisting of a heating portion 16 including a preheating, heating and soaking zones, and a cooling zone 17. This line further comprises a first neutral salt electrolytic cell 18, a second neutral salt electrolytic cell 19, a final treating bath 20, a scrubber 21, a drier 22, a looper 23 on an exit side, a shearing machine 24, and a tension reel 25.

In the above APL, a steel strip S unwounded from the pay-off reel 11 is cut at its leading end or trailing end with the shearing machine 12 at the entry side and is welded by the welder 13 to another preceding or following steel strip. The steel strip S is then introduced through the looper 14 into the annealing furnace 15 to be subjected to a predetermined heat-treatment. During this treatment, the steel strip is supported in catenary by asbestos rolls 16*r* and is subjected to heat-treatment by direct fire burners and then cooled in the cooling zone with the aid of water and/or air. Thereafter, the steel strip is subjected to descaling and a process for making it into passive state in the first and second neutral salt electrolytic cells 18 and 19 and the final treating bath 20. $Na_2SO_4$ is used as the neutral salt. In the final treating bath 20, the pickling is effected by the use of $HNO_3$ for ferrite stainless steel and a mixed acid of $HNO_3$ and HF for austenite stainless steel. Such pickling procedures are summarized in FIG. 2.

After cleaning surfaces of the steel strip by the scrubber 21 and drying the steel strip by the drier 22, the steel strip passes through the looper 23 on the exit side and is cut by the shearing machine 24 on the exit side into predetermined lengths after which they are wound about the tension reel 25.

As shown in FIG. 1, horizontal furnaces supporting therein steel strips in catenary and equipped with direct fire burners are generally used for APL. The furnaces of this type are usually employed for the following reasons.

Annealing temperatures for ferrite stainless steels such as SUS 430 (Japanese Industrial Standard) are 780°-850° C. which are only somewhat higher than those of normal steel strips. However, annealing temperatures for austenite stainless steels such as SUS 304 (Japanese Industrial Standard) are 1,010°-1,150° C. which is very high. Owing to such a high temperature annealing, direct fire heating system has been used as heating means in consideration of productivity and preservation without using direct heating type heaters used for normal steels.

With the direct fire heating system, however, oxide films occur on surfaces of steel strips, so that descaling by pickling after annealing is absolutely necessary.

The oxide films produced on stainless steels are much denser and stronger than those of normal steels. Such oxide films become denser as the concentration of $O_2$ in the furnace becomes to zero. In order to facilitate the descaling treatment in later pickling process, therefore, oxidizing atmosphere has been maintained in furnaces, whose oxygen concentration is of the order of 2-3%.

As a result, the oxidizing atmosphere increases oxide scales which tend to attach to hearth rolls and grow further to cause so-called "pick-up" defects. In order to prevent the "pickup" defects, the hearth rolls are made of asbestos and the number of the hearth rolls is made as small as possible to support the stainless steel strip in catenary (Japanese Patent Application Publication No. 26,723/77). As above described, the horizontal furnaces supporting therein steel strips in catenary and equipped with direct fire burners are mainly used for APL.

As above described, the continuous annealing and pickling lines (APL) of the prior art cannot avoid oxide scales which, however, are removed in later pickling treatment. This pickling treatment serves not only to descale but also to bring the steel strip to the passive state in order to improve its corrosion-resistance. For these purposes, nitric acid, sulfuric acid and mixed acid of nitric acid and hydrofluoric acid have been used in combination. Recently, salt bath, neutral salt electrolytic cell and the like have been used.

In the continuous annealing and pickling installations of the prior art as above described, the treating lines become greatly large and long, while production capacity still stays at the lower level.

In order to obtain a production capacity of 15 ton/h, for example, the horizontal furnace supporting steel strips in catenary and equipped with direct fire burners has a length of about 45 m and the pickling bath has a length of about 50 m, that is to say, the installation of overall length of as much as 100 m is needed.

In order to avoid the pickup defects, moreover, the asbestos rolls must be frequently exchanged such as a few times a month, so that there is a difficulty in productivity and maintenance.

Moreover, in addition to a plurality of pickling baths respectively including different pickling liquids, additional apparatuses such as acid solution supply apparatuses, acid solution circulating apparatuses. Furthermore, corrosion by the acid solutions makes difficult the maintenance. Moreover, these pickling solutions are troublesome in management.

Furthermore, an acid fume treating apparatus, a waste acid treating apparatus, a water treating apparatus and the like are needed for environmental sanitation.

SUMMARY OF THE INVENTION

It is a principal object of the invention to provide a method and an apparatus for continuously annealing and pickling steel strips, particularly stainless steel strips, which eliminate all the disadvantages of the prior art and which are abound in productivity, compact in construction and easy in maintenance.

In order to achieve this object, in a method of continuously annealing and pickling steel strips successively transferred through a continuous annealing apparatus including heating and cooling zones and a pickling apparatus, according to the invention, annealing the steel strips is effected in reducing atmosphere and thereafter pickling is effected at least by nitric acid electrolytic treatment.

In an apparatus for continuously annealing and pickling steel strips, including a continuous annealing furnace and a pickling apparatus, according to the invention the continuous annealing furnace consists of vertical furnaces capable of advancing a steel strip in a manner substantially repeating upward and downward movements alternately in substantially vertical directions and the pickling apparatus comprises at least a nitric acid electrolytic cell.

In another aspect of the invention, the continuous annealing furnace consists of one pass furnace capable of advancing the steel strip only once and forming a high temperature heating zone and a high temperature cooling zone of the annealing furnace and vertical furnaces respectively forming a low temperature heating zone and a low temperature cooling zone and capable of advancing a steel strip in a manner substantially repeating upward and downward movements alternately in substantially vertical directions and said pickling apparatus comprises at least a nitric acid electrolytic cell.

The one pass furnace may be vertical or horizontal.

The invention will be more fully understood by referring to the following detailed specification and claims taken in connection with the appended drawings.

DESCRIPTION OF THE PREFERRED EMBODIMENTS

Figure 1:
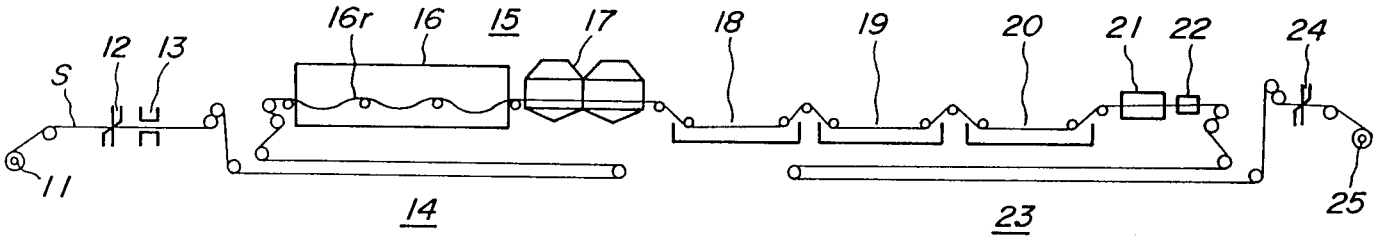
FIG. 1 PRIOR ART
FIG. 1 is a schematic view of a continuous annealing and pickling apparatus of the prior art.
Figure 2:
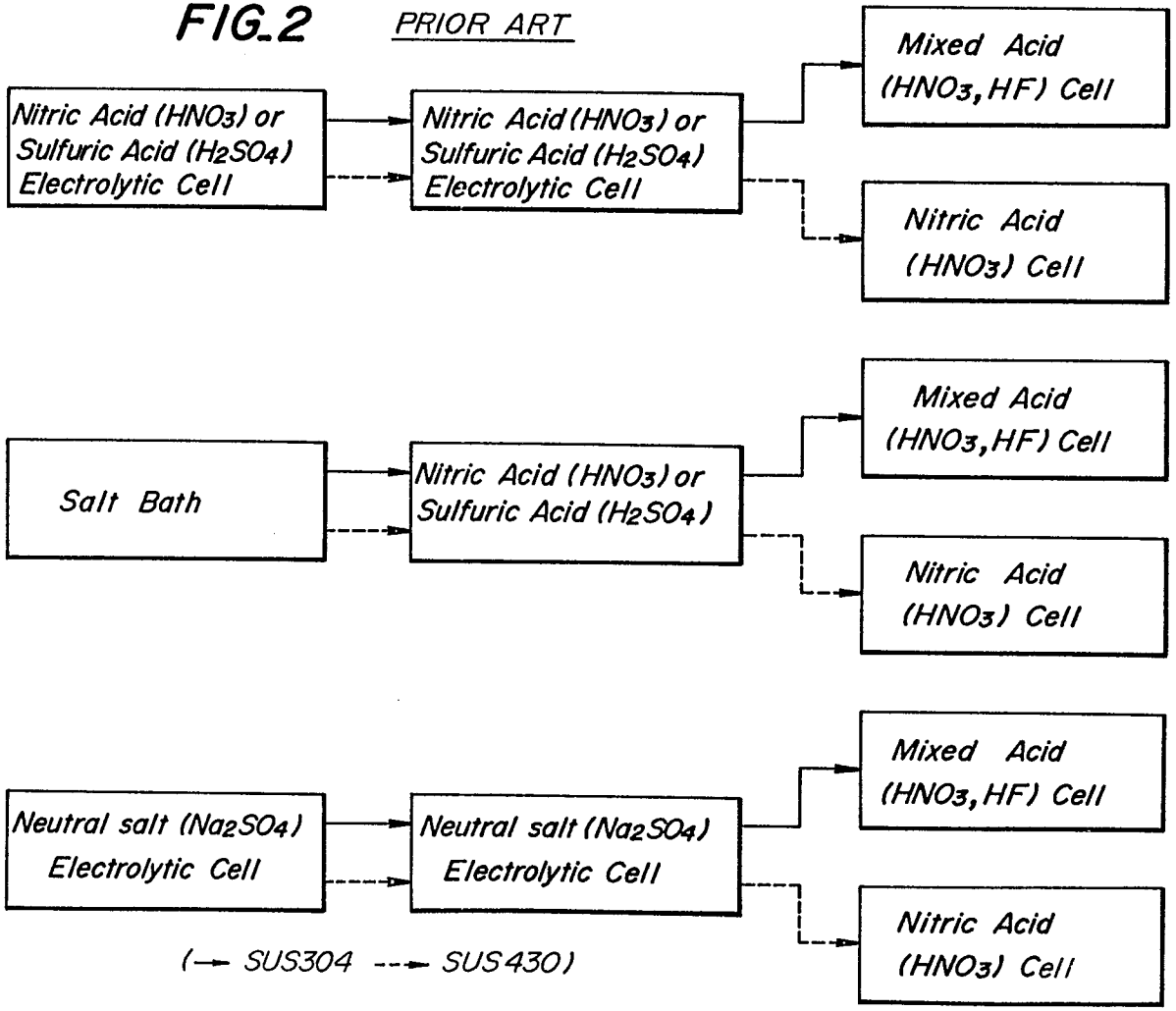
FIG. 2 PRIOR ART
FIG. 2 is a block diagram of pickling processes of the prior art.
Figure 3:
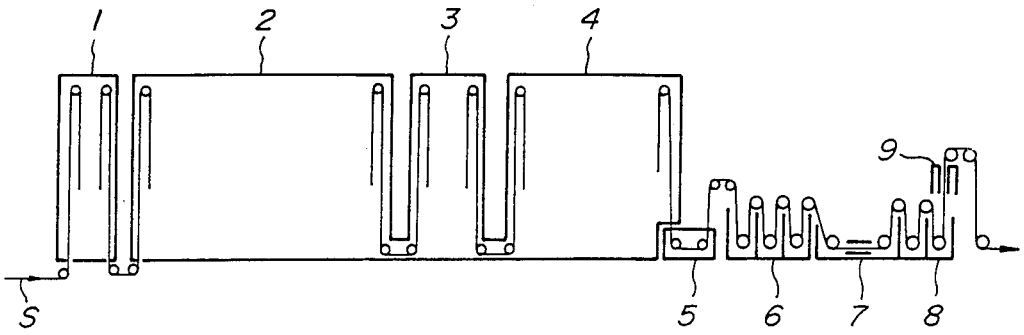
FIG. 3 is a schematic view of a continuous annealing and pickling apparatus according to the invention.

FIG. 3 illustrates a preferred embodiment of the invention which respective zones of an annealing line are constructed by vertical furnaces.

It comprises a preheating zone 1, a heating zone 2, a soaking zone 3, a cooling zone 4, a final cooling apparatus 5, a sulfuric acid bath 6, a nitric acid electrolytic pickling bath 7, a cleaning apparatus 8 consisting of sprayers, brushes, scrubbers and the like, and a drier 9.

With this preferred embodiment, respective zones are constructed by vertical furnaces including a number of hearth rolls arranged in upper and lower positions in the furnaces. A steel strip S is trained around these hearth rolls in succession to be subjected to the heat-treatment, during which the steel strip S is advanced in a manner substantially repeating upward and downward movements alternately in substantially vertical directions. The steel strip S is heated indirectly by radiant tubes or the like in reducing atmosphere such as $H_2$ and $N_2$ gases in the furnaces, so that oxide scale scarcely occur in the furnaces. Even if such the number of hearth rolls are used, there is no risk of occurrence of "pickup" defects due to oxide scales attached to the hearth rolls and growing thereat. The reducing atmosphere gas preferably consists of 3–15% of $H_2$ and remainder of $N_2$.

As all the furnaces are vertical, the length of the passage for the steel strips can be elongated. such an elongated passage can increase the passing speed or production of the steel strip greatly, remarkably compensating for the demerit in the conversion of the direct fire heating into indirect heating. Moreover, an overall length of the furnaces can be remarkably shortened.

The radiant tubes have been somewhat inferior in thermal efficiency to the direct fire heating means. However, materials of the radiant tubes have been recently improved in various aspects, so that radiant tubes using heat-resistant alloys or ceramics are not inferior to the direct fire heating means.

Moreover, expensive rolls such as asbestos rolls are not needed and a heat-resistant cast steel such as SCH 22 (Japanese Industrial Standard) is sufficiently used for making the rolls.

According to the invention, moreover, it is possible to carrying out the heat-treatment at higher speeds than those of the prior art APL. In case of such a high speed treatment, there is a risk causing serpentine movements of steel strips. However, this problem is easily solved by providing the hearth rolls with appropriate crowning.

Figure 4:
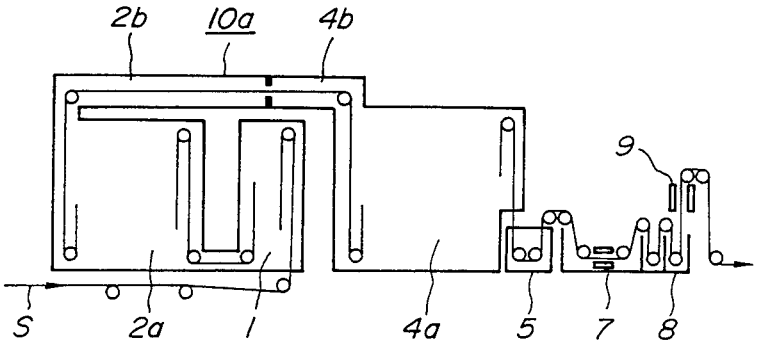
FIG. 4 is a schematic view of another embodiment of the invention.
Figure 5:
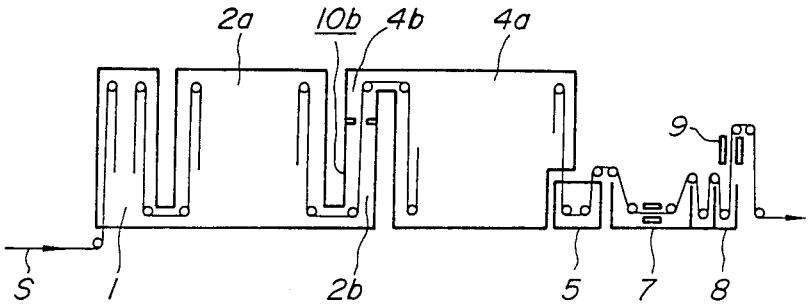
FIG. 5 is a schematic view of a further embodiment of the invention.

FIGS. 4 and 5 illustrate other preferred embodiments of the invention, respectively.

In the above embodiments, heating zones 2 and cooling zones 4 are divided into high temperature portions and low temperature portions, respectively. Low temperature heating zones 2*a* and low temperature cooling zones 4*a* are constructed by vertical furnaces, while high temperature heating zones 2*b* and high temperature cooling zone 4*b* are constructed by one pass furnaces 10, each capable of advancing a steel strip only once. The one pass furnace 10*a* is horizontal in the embodiment shown in FIG. 4, while the one pass furnace 10*b* is vertical in FIG. 5.

With cold rolled stainless steel strips, oxide scales often already occur in the air before annealing. In the low temperature heating zone, moreover, even if the steel strip is kept in reducing atmosphere, a slight amount of the air often enters the zone to oxidize the strip. In this case, there is a risk of occurrence of fine "pickup" defects on the strip occurring in the high temperature zones. In the embodiments in FIGS. 4 and 5, the one pass furnaces not using winding type hearth rolls are employed for the high temperature zones, which are not vertical furnaces, thereby eliminating the risk of occurrence of the pickup defects.

In case of the vertical one pass furnace as in the embodiment in FIG. 5, the steel strip may of course be supported by hearth rolls made of asbestos in catenary in the conventional manner to prevent the pickup defects. It is more effective for preventing the pickup defects to provide gas-floating means below the steel strip to support it in catenary without direct contact with the strip.

Gas jet heating and radiant tubes are preferable for heating and high temperature zones. On the other hand, for cooling the high temperature cooling zone, gas jet cooling is preferable for preventing the pickup defects, and for cooling the lower temperature cooling zone, either of gas jet cooling and cooling by roll is preferable.

In order to prevent the serpentine movement of stainless steel strips, moreover, hearth rolls are preferably provided with crowning as above described. However, as the strength of the stainless steel strip lowers in the high temperature zones, there is a risk of buckling of the strip due to the roll crowning. In this case, it is needed to make small the crowning of the hearth rolls in the high temperature zones. With the annealing furnaces as shown in FIGS. 4 and 5, there is no risk of occurrence of any heat-backling because winding type heaerth rolls are not used in the high temperature zones.

5% and 10%. The time required for pickling was 2 seconds for both the cases.

It is clearly evident from FIGS. 5*a* and 5*b* that when the current density is low, somewhat higher liquid temperature is effective to improve the pickling operation.

In contrast herewith, in order to obtain good surface conditions of steel strips by pickling according to the prior art, it requires not only a plurality of pickling baths including different acids as shown in Table 1 but also high current densities for nitric acid pickling and long time for the pickling treatment.

TABLE 1

| | | | | Sulfuric acid cell | | | | Nitric and hydrofluoric acid cell | | | Nitric acid cell | | | |
|---|---|---|---|---|---|---|---|---|---|---|---|---|---|---|
| Steel strip | Thickness (mm) | Passing speed (mpm) | Salt bath temperature (°C.) | Concentration (%) | Temperature (°C.) | Time (sec) | Current density (A/dm$^2$) | Concentration (%) | Temperature (°C.) | Time (sec) | Concentration (%) | Temperature (°C.) | Time (sec) | Current density (A/dm$^2$) |
| SUS | 0.8 | 25 | 400 | 7 | 45 | 48 | 13 | 4 | 55 | 36 | 10 | 45 | 36 | 15 |
| 304 | 1.6 | 18 | 400 | 7 | 45 | 67 | 13 | 4 | 55 | 50 | 10 | 45 | 50 | 15 |
| SUS | 0.8 | 20 | 400 | 4 | 45 | 60 | 13 | | | | 10 | 50 | 36 | 15 |
| 430 | 1.6 | 15 | 400 | 4 | 45 | 80 | 13 | | | | 10 | 50 | 50 | 15 |

After the steel strip has been heated, soaked and cooled to a temperature (about 250° C.) at which temper color does not occur, the steel strip is moved out of the last furnace and is preferably subjected to immersing cooling process by cooling water.

Figure 6:
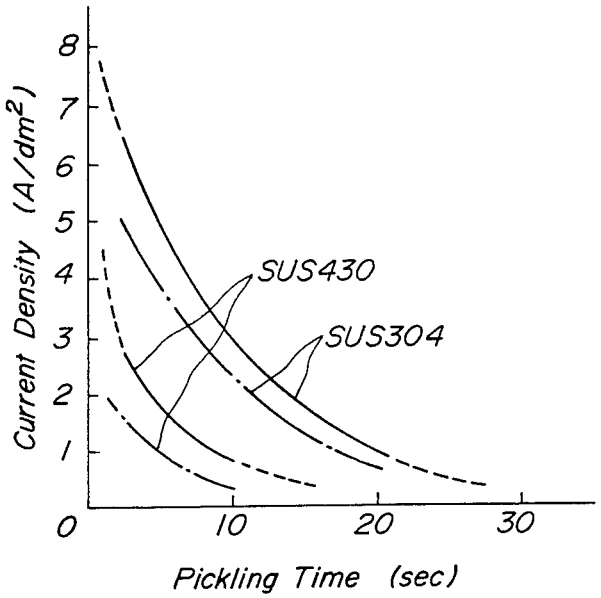
FIG. 6 is a graph illustrating relations between pickling time and current density in nitric acid electrolytic pickling according to the invention.

The pickling treatment according to the invention will be explained hereinafter. In FIG. 6, solid lines illustrate examples of the relation between current density and time required for pickling by nitric acid electrolytic cells. Nitric acids were used with 10% concentration at 50° C. for SUS 430 and with 15% concentration at 55° C. for SUS 304 (Japanese Industrial Standard).

As seen from FIG. 6, the pickling was completed for 2–3 seconds with relatively high current densities and for 10–20 seconds with low current densities.

Moreover, dot-and-dash lines in FIG. 6 illustrate the relations between the current density and time required for pickling in the event that after steel strips have been immersed in sulfuric acid ($H_2SO_4$) with 20% concentration at 70° C., the steel strips are subjected to the electrolytic pickling with the above nitric acid liquid. The significant effect of the invention is clearly shown in FIG. 6.

If it is desired to lower the current density for nitric acid electrolytic pickling, separate pickling may of course be combined with as shown in FIG. 6.

As above described, according to the invention as the continuous annealing is carried out in reducing atmosphere, only the nitric acid electrolytic treatment is sufficient for the pickling after annealing. Moreover, good pickled surfaces of steel strips can be obtained only with current densities less than 10 A/dm$^2$ and for short time less than 15 seconds.

As can be seen from the above description, the annealing apparatus according to the invention can be used for annealing normal cold rolled steel strips without any modification, so that it exhibits a great performance to be used for both stainless steel strips and normal steel strips.

EXAMPLE

Cold rolled steel strips of SUS 430 having 0.8 mm thickness and 1,015 mm width were subjected to continuous annealing and pickling treatment by the use of the apparatus shown in FIG. 3 under conditions shown in Table 2.

TABLE 2

| Operating condition | Annaling conditions | Pickling conditions | | |
|---|---|---|---|---|
| Line speed | Soaking | A | | Nitric acid electrolytic pickling |
| 250 mpm | temperature 820° C. | | | |
| 97 T/H | Soaking time 30 sec | | | $HNO_3$ concentration 10%<br>Current density 4 A/dm$^2$<br>Temperature 50° C.<br>Time for electrolytic pickling 2 sec |
| | Atmosphere in furnaces | B | Sulfuric acid pickling | Nitric acid electrolytic pickling |
| | $H_2$ 10%<br>$N_2$ 90% | | $H_2SO_4$ concentration 20%<br>Temperature 70° C.<br>Immersing time 15 sec | $HNO_3$ concentration 10%<br>Current density 2 A/dm$^2$<br>Temperature 50° C.<br>Time for electrolytic pickling 2 sec |

Figure 7A:
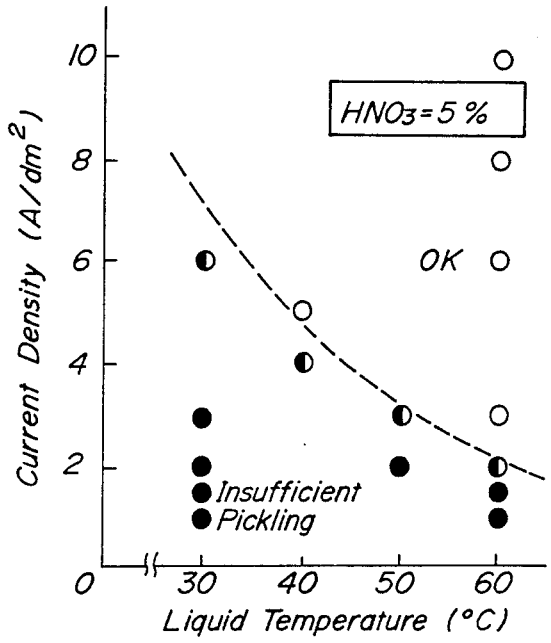
FIGS. 7*a* and 7*b* are graphs illustrating relations between current density and liquid temperature in order to obtain good pickled surfaces of steel strips with nitric acid concentration 5% and 10%, respectively.
Figure 7B:
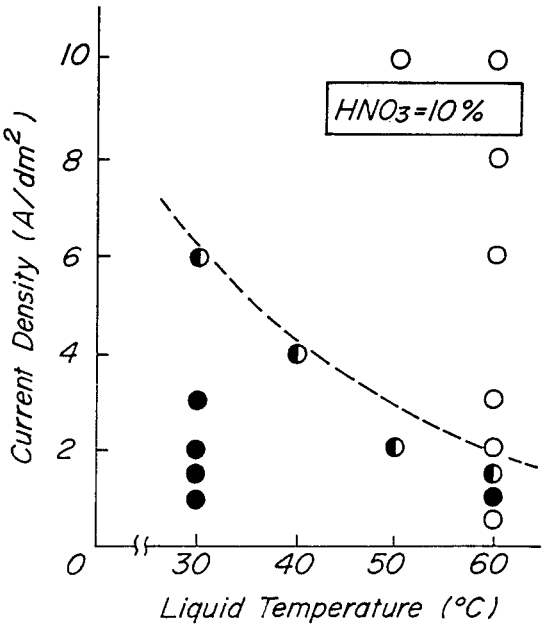

FIGS. 7*a* and 7*b* illustrate relation between current density and pickling liquid temperature for effectively achieving the pickling with nitric acid concentrations of In the Table 2, only the nitric acid electrolytic pickling was used in the case A, while both the sulfuric acid pickling and the nitric acid electrolytic pickling were used in the case B.

Moreover, cold rolled steel strips of SUS 304 having 0.8 mm thickness and 1,015 mm width were treated by the continuous annealing and pickling by the use of the apparatus shown in FIG. 4 under conditions in Table 3.

TABLE 3

| Operating conditions | Annealing conditions | Pickling conditions |
|---|---|---|
| Line speed | Low temperature heating | Nitric acid electrolytic pickling |
| 250 mpm | zone exit temperature 650° C. | $HNO_3$ concentration 15% |
| 97 T/H | High temperature heating | Temperature 55° C. |
| | zone maximum temperature 1,075° C. | Current density 7 A/dm$^2$ |
| | Using floaters | Time for electrolytic |
| | Atmosphere in furnaces | pickling 2 sec |
| | $H_2$ 10% | |
| | $N_2$ 90% | |

The steel strip thus treated exhibited good surface conditions without any pickup defects, temper color and insufficiently pickled portions on the surfaces, and had required mechanical properties.

The overall length of the apparatuses shown in FIGS. 3 and 4 were about 60 m and 50 m, respectively, which were approximately one half and two thirds of those of the prior art.

The effects of the invention will be summarized as follows.

(1) The treating performance is greatly improved, while the length of the apparatus is considerably shortened.
(2) Pickup defects are completely avoided by the reducing atmosphere in the annealing furnaces and by supporting the steel strips without directly contacting them in the high temperature zone.
(3) Asbestos rolls are not needed, so that exchanging operation of rolls are eliminated to lower the initial and operating cost.
(4) There is little oxide scale on steel strips, so that lowering of yield rate due to scale loss is prevented.
(5) The less number of pickling cells sufficiently serve to pickle large amounts of steel strips, so that management of medical liquids is very easy and their prices can be saved.
(6) Additional installations to the pickling apparatus such as acid supply, waste acid disposal, acid circulating equipment, and fume and water treatment equipment can be considerably reduced to improve the operating environment.

While the invention has been particularly shown and described with reference to preferred embodiments thereof, it will be understood by those skilled in the art that the foregoing and other changes in form and details can be made therein without departing from the spirit and scope of the invention.

What is claimed is:

1. A method of continuously annealing and pickling cold rolled stainless steel strips successively transferred through a continuous annealing apparatus including heating and cooling zones and a pickling apparatus, wherein annealing the strips is effected in reducing atmosphere consisting of hydrogen within a range of 3–15% and nitrogen of substantially the remainder and thereafter pickling is effected at least by nitric acid electrolyte treatment.

2. A method as set forth in claim 1, wherein a steel strip is advanced in said heating and cooling zones in a manner substantially repeating upward and downward movements alternately in substantially vertical directions.

3. A method as set forth in claim 1, wherein said heating and cooling zones are divided into low temperature heating, high temperature heating, high temperature cooling and low temperature cooling zones, and a steel strip is advanced in said low temperature heating and cooling zones in a manner substantially repeating upward and downward movements alternately in substantially vertical directions and advanced only once in said high temperature heating and cooling zones in a substantially horizontal direction.

4. A method as set forth in claim 1, wherein said heating and cooling zones are divided into low temperature heating, high temperature heating, high temperature cooling and low temperature cooling zones, and a steel strip is advanced in said low temperature heating and cooling zones in a manner substantially repeating upward and downward movements alternately in substantially vertical directions and advanced only once in said high temperature heating and cooling zones in a substantially vertical direction.

5. An apparatus for continuously annealing and pickling cold rolled stainless steel strips, including a continuous annealing furnace and a pickling apparatus, wherein said continuous annealing furnace consists of vertical furnaces capable of advancing a steel strip through reducing atmosphere consisting of hydrogen within a range of 3–15% and nitrogen of substantially the remainder in a manner substantially repeating upward and downward movements alternately in substantially vertical directions and said pickling apparatus comprises at least a nitric acid electrolytic cell.

6. An apparatus for continuous annealing and pickling cold rolled stainless steel strips, including a continuous annealing furnace and a pickling apparatus, wherein said continuous annealing furnace consists of one pass furnace capable of advancing the steel strip through reducing atmosphere consisting of hydrogen within a range of 3–15% and nitrogen of substantially the remainder only once and forming a high temperature heating zone and a high temperature cooling zone of the annealing furnace, and vertical furnaces respectively forming a low temperature heating zone and a low temperature cooling zone and capable of advancing a steel strip in a manner substantially repeating upward and downward movements alternately in substantially vertical directions and said pickling apparatus comprises at least a nitric acid electrolytic cell.

7. An apparatus for continuously annealing and pickling steel strips as set forth in claim 6, wherein said one pass furnace is horizontal and capable of advancing the steel strip only once in a horizontal direction.

8. An apparatus for continuously annealing and pickling steel strips as set forth in claim 6, wherein said one pass furnace is vertical and capable of advancing the steel strip only once in a vertical direction.

* * * * *